US007165600B2

(12) United States Patent
Grassi et al.

(10) Patent No.: US 7,165,600 B2
(45) **Date of Patent: *Jan. 23, 2007**

(54) CHEMICALLY BONDED AGGREGATE MOLD

(75) Inventors: John R. Grassi, Kennesaw, GA (US); John Campbell, Wast Malvern (GB); George W. Kuhlman, Coral Springs, FL (US)

(73) Assignee: Alotech Ltd. LLC, Kennesaw, GA (US)

( * ) Notice: Subject to any disclaimer, the term of this patent is extended or adjusted under 35 U.S.C. 154(b) by 46 days.

This patent is subject to a terminal disclaimer.

(21) Appl. No.: 10/658,919

(22) Filed: Sep. 10, 2003

(65) Prior Publication Data

US 2004/0045698 A1 Mar. 11, 2004

Related U.S. Application Data

(60) Provisional application No. 60/409,789, filed on Sep. 11, 2002.

(51) Int. Cl.
*B22C 9/00* (2006.01)

(52) U.S. Cl. ..... 164/528; 164/529; 164/131; 164/522

(58) Field of Classification Search ..... 164/528, 164/529, 131, 34, 361, 522, 345
See application file for complete search history.

(56) References Cited

U.S. PATENT DOCUMENTS

| | | | | |
|---|---|---|---|---|
| 22,865 A | | 2/1859 | Gardiner | |
| 185,376 A | | 12/1876 | Whitehouse | |
| 381,655 A | | 4/1888 | Stover | |
| 927,495 A | | 7/1909 | Custer | |
| 1,241,867 A | | 10/1917 | McMillen | |
| 2,968,848 A | * | 1/1961 | Carter | 164/128 |
| 3,124,452 A | | 3/1964 | Kraft | |
| 3,540,519 A | | 11/1970 | Yates | |
| 3,620,291 A | | 11/1971 | Delachapelle | |
| 3,863,702 A | | 2/1975 | Hallerberg et al. | |

(Continued)

FOREIGN PATENT DOCUMENTS

| | | |
|---|---|---|
| CH | 622 726 | 4/1981 |

(Continued)

OTHER PUBLICATIONS

Patent Abstracts of Japan; Publication No. 61007058; Publication Date Jan. 13, 1986.

(Continued)

*Primary Examiner*—Kevin Kerns
*Assistant Examiner*—I.-H. Lin
(74) *Attorney, Agent, or Firm*—Fay, Sharpe, Fagan, Minnich & McKee, LLP

(57) ABSTRACT

A mold for the casting of metals including an aggregate comprising a refractory particulate material and a soluble binder which provides for minimal heat transfer between the mold and the molten metal during filling. The aggregate preferably includes at least a proportion of particulate material having a heat diffusivity at least as low as silica sand to reduce the chilling effect of the mold. The mold is removed from the casting the action of a solvent, which simultaneously cools and solidifies the casting at a maximum rate. Processes for forming the mold and the casting of metals using the mold are also disclosed.

42 Claims, 3 Drawing Sheets

U.S. PATENT DOCUMENTS

| | | | | | |
|---|---|---|---|---|---|
| 3,958,619 | A | | 5/1976 | Petersen et al. | |
| 4,222,429 | A | | 9/1980 | Kemp | |
| 4,347,890 | A | | 9/1982 | Ailin-Pyzik et al. | |
| 4,399,858 | A | | 8/1983 | Kurabe et al. | |
| 4,548,256 | A | | 10/1985 | Glinn et al. | |
| 4,580,616 | A | * | 4/1986 | Watts | 164/457 |
| 4,582,118 | A | | 4/1986 | Jacoby et al. | |
| 4,607,091 | A | | 8/1986 | Schreiber | |
| 4,610,295 | A | | 9/1986 | Jacoby et al. | |
| 4,629,708 | A | | 12/1986 | Alexander et al. | |
| 4,709,740 | A | | 12/1987 | Jacoby et al. | |
| 4,724,887 | A | | 2/1988 | Jacoby et al. | |
| 4,802,525 | A | | 2/1989 | Heine et al. | |
| 4,971,134 | A | * | 11/1990 | Kawaguchi et al. | 164/122 |
| 4,987,950 | A | | 1/1991 | Yu | |
| 5,143,665 | A | | 9/1992 | Clubbs et al. | |
| 5,148,853 | A | | 9/1992 | Yu et al. | |
| 5,158,130 | A | * | 10/1992 | Sahari | 164/528 |
| 5,294,648 | A | | 3/1994 | Smith et al. | |
| 5,327,955 | A | | 7/1994 | Easwaran | |
| 5,333,673 | A | | 8/1994 | Hughes | |
| 5,439,045 | A | | 8/1995 | Crafton | |
| 5,573,055 | A | | 11/1996 | Melling et al. | |
| 5,632,326 | A | | 5/1997 | Gough | |
| 5,641,015 | A | | 6/1997 | Challand | |
| 5,681,407 | A | | 10/1997 | Yu et al. | |
| 5,725,044 | A | | 3/1998 | Hirokawa | |
| 5,738,162 | A | | 4/1998 | Crafton | |
| 5,810,918 | A | | 9/1998 | Landis | |
| 5,820,705 | A | | 10/1998 | Yu et al. | |
| 5,913,354 | A | | 6/1999 | Conroy et al. | |
| 5,915,452 | A | * | 6/1999 | Conroy et al. | 164/345 |
| 5,957,188 | A | | 9/1999 | Crafton | |
| 5,983,984 | A | | 11/1999 | Auderheide et al. | |
| 6,139,619 | A | | 10/2000 | Zaretskiy et al. | |
| 6,286,585 | B1 | | 9/2001 | Twardowska et al. | |
| 6,335,387 | B1 | | 1/2002 | Twardowska et al. | |
| 6,336,809 | B1 | | 1/2002 | Crafton et al. | |
| 6,372,032 | B1 | | 4/2002 | Miki | |
| 6,390,178 | B1 | | 5/2002 | Makino | |
| 6,416,572 | B1 | * | 7/2002 | Eldemallawy et al. | 106/38.27 |
| 6,447,593 | B1 | | 9/2002 | Sargent et al. | |
| 6,469,299 | B1 | | 10/2002 | Chutjian et al. | |
| 6,547,556 | B1 | | 4/2003 | Crafton et al. | |
| 6,551,396 | B1 | * | 4/2003 | Pineda et al. | 106/38.9 |
| 2002/0020511 | A1 | | 2/2002 | Crafton et al. | |
| 2002/0104596 | A1 | | 8/2002 | Crafton et al. | |
| 2004/0055728 | A1 | | 3/2004 | Lewis, Jr. et al. | |
| 2005/0022957 | A1 | | 2/2005 | Crafton et al. | |
| 2005/0072549 | A1 | | 4/2005 | Crafton et al. | |
| 2005/0145362 | A1 | | 7/2005 | Crafton et al. | |

FOREIGN PATENT DOCUMENTS

| | | | | |
|---|---|---|---|---|
| DE | 32 15 809 | | 11/1983 | |
| DE | 36 16 168 | | 11/1987 | |
| DE | 195 25 307 | | 1/1997 | |
| EP | 0 141 666 | | 5/1985 | |
| EP | 0 119 365 | | 9/1987 | |
| EP | 0 744 233 | | 11/1996 | |
| EP | 0 796 681 | | 9/1997 | |
| FR | 2 614 814 | | 11/1988 | |
| GB | 1 549 220 | | 7/1979 | |
| GB | 2 070 627 | | 9/1981 | |
| GB | 2 248 569 | A | 4/1992 | |
| JP | 59156566 | * | 9/1984 | 165/35 |
| JP | 61245938 | * | 11/1986 | |
| JP | 5-169185 | | 7/1993 | |
| WO | 93 19870 | | 10/1993 | |

OTHER PUBLICATIONS

Patent Abstracts of Japan, vol. 011, No. 094, Mar. 25, 1987 & JP 61 245938, Asahi Organic Chem. Ind. Co. Ltd., Nov. 1, 1986.

Veltrup E.M., "Kurze Entkernungszeiten Beim Entkernen Mit Hochdruckwasserstrah", Giesserei, Giesserei Verlag, Dusseldorf, Germany, vol. 74, No. 4, Feb. 18, 1987, pp. 102-104.

Patent Abstracts of Japan, JP-60247458 (Mazda Motor Corp.) Dec. 7, 1985.

Niedling, Jake J. et al., "Evaluating RSI Sows For Safe Charging Into Molten Metal", Light Metals 2003, TMS (The Minerals, Metals & Materials Society), 2003, pp. 695-700.

Ekenes, J. Martin et al., "Cause and Prevention of Explosions Involving Hot-Top Casting of Aluminum Extrusion Ingot", Light Metals 2003, TMS (The Minerals, Metals & Materials Society), 2003, pp. 687-693.

* cited by examiner

CHEMICALLY BONDED AGGREGATE MOLD

This application claims priority from U.S. provisional application No. 60/409,789, filed Sep. 11, 2002.

FIELD OF THE INVENTION

The present invention relates to the casting of metals. More particularly, the present invention relates to a method and an apparatus for the mold-removal casting of metals using a mold having low heat diffusivity.

BACKGROUND OF THE INVENTION

In the traditional casting process, molten metal is poured into a mold and solidifies, or freezes, through a loss of heat to the mold. When enough heat has been lost from the metal so that it has frozen, the resulting product, i.e., a casting, can support its own weight. The casting is then removed from the mold.

In conventional molding techniques, different types of molds of the prior art offer certain advantages. For example, green sand molds are composed of a particulate or granular material, typically sand, which is held together with a binder such as a mixture of clay and water. These molds may be manufactured rapidly for simple molds in an automated mold making plant. In addition, the sand can be recycled for further use relatively easily.

Other sand molds often use resin based chemical binders that possess high dimensional accuracy and high hardness. Such resin-bonded sand molds take somewhat longer to manufacture than green sand molds because a curing reaction must take place for the binder to become effective and allow formation of the mold. As in clay-bonded molds, the sand can often be recycled, although with some treatment to remove the resin.

In addition to relatively quick and economical manufacture, sand molds also have high productivity. A sand mold can be set aside after the molten metal has been poured to allow it to cool and solidify, allowing other molds to be poured.

The sand that is used in an aggregate in sand molding is most commonly silica. However, other minerals have been used to avoid the undesirable transition from alpha quartz to beta quartz at about 570 degrees Celsius (° C.), or 1,058 degrees Fahrenheit (° F.). Such other minerals include olivine, chromite and zircon. These minerals possess certain disadvantages. Olivine is often variable in its chemistry, leading to problems of uniform control with chemical binders. Chromite is typically crushed, creating angular grains that lead to a poor surface finish on the casting and rapid wear of tooling. Zircon is heavy, increasing the demands on equipment that is used to form and handle a mold and causing rapid tool wear.

As an alternative to sand molds, molds made of metal are sometimes used. These metal molds are particularly advantageous because their relatively high heat diffusivity allows the cast molten metal to cool and solidify quickly, leading to advantageous mechanical properties in the casting. For example, a particular casting process known as pressure die casting utilizes metal molds and is known to have a rapid solidification rate. Such a rapid rate of solidification is indicated by the presence of fine dendrite arm spacing (DAS) in the casting. As known in the art, the faster the solidification rate, the smaller the DAS. However, pressure die casting often allows the formation of defects in a cast part because extreme surface turbulence occurs in the molten metal during the filling of the mold.

Moreover, since the manufacture of metal molds is relatively expensive, such molds possess a significant economic disadvantage. Because the casting must freeze before it can be removed from the mold, multiple metal molds must be used to achieve high productivity. The need for multiple molds in permanent mold casting increases the cost of tooling and typically results in costs for tooling that are at least five times more than those associated with sand molds.

In typical casting methods, rapid solidification of the molten metal is often desirable, as it is known in the art that with such cooling the mechanical properties of the casting are improved. In addition, rapid solidification and cooling allows the retention of more of the alloying elements in solution, thereby introducing the possibility of eliminating subsequent solution treatment, which saves time and expense. To facilitate this rapid solidification and cooling, molds have previously been made of such materials and in such a manner as to possess a high heat diffusivity, a parameter that includes the contributions of thermal conductivity, heat capacity, and density and relates to the ability of the mold to extract heat from the casting. More specifically, heat diffusivity D (with units of $Jm^{-2}K^{-1}s^{-1/2}$) is the square root of the product of thermal conductivity K (J/mKs), density ρ ($kg/m^3$) and specific heat C (Jkg/K) and formally defined as $D=(K\rho C)^{1/2}$. As used herein, the heat diffusivity is the measure of the chilling power of the mold material.

These molds act as a "chill" to the molten metal, absorbing the superheat of the molten metal or permitting it to diffuse away and allowing the molten metal in the mold to quickly solidify or freeze. As used herein, "superheat" is used to refer to the temperature of a molten metal in excess of its melting temperature.

Nevertheless, for some types of molding processes, the opposite has often been found to be true. That is, it is sometimes desirable to use a mold that does not act as a chill in any manner to the molten metal during fill. This is particularly true if the molten metal is cast through the thin sections of a mold into thicker sections. The thermal energy of the molten metal is typically lost in the thin sections of the mold during the fill. This heat transfer can result in the molten metal becoming semi-solid and arrest the molten metal front, preventing the molten metal from advancing uniformly into the rest of the mold. Both sand and metal prior art molds act as a chill to the molten metal, albeit sand to a lesser degree due to its lower heat diffusivity.

As a result, it is desirable to develop a casting process and related apparatus that will provide for minimal heat transfer between the mold and the molten metal during filling while still allowing rapid cooling of the casting after the mold has been filled. Thus, there is a need to develop a mold material having low heat diffusivity while also allowing the rapid cooling of the metal casting after filling of the mold is complete as well as having the lower costs, high productivity and the reclaimability associated with other aggregate molds such as silica sand molds.

BRIEF SUMMARY OF THE INVENTION

In one aspect of the present invention, a process for the casting of metals is provided. The process includes the steps of forming a mold from an aggregate comprising a particulate material and a binder, delivering a molten metal into the mold, contacting a solvent with the mold, cooling the molten metal such that it at least partially solidifies to form a casting, and removing at least a part of the mold.

In another aspect of the present invention, a method for producing a mold having low heat diffusivity is provided. The method includes the steps mixing a particulate material with a binder to form a moldable mixture, packing the mixture into a shaped pattern or tool to shape a mold or core, removing the mold or core in its green state from the pattern or tool, and drying the green state mold or core.

Alternative methods include (i) first partially curing the mold or core prior to removal from the patternwork or tooling, or (ii) first completely curing the mold or core in the patternwork or tooling. Such methods are preferred techniques because the potential for the distortion of the very weak mold or core in its green state is thus avoided.

In still another aspect of the present invention, a mold for the casting of metals is provided. The mold includes an aggregate comprising a particulate or granular material and a binder, wherein the mold may be eroded away using a solvent.

In yet another aspect of the invention, a method for forming a casting from a molten metal is provided. The method includes the steps of forming at least a part of a mold from an particulate material and a binder, delivering a molten metal into the mold, contacting said at least a part of the mold with a solvent, removing the at least a part of the mold, and solidifying and cooling the molten metal to form a casting.

BRIEF DESCRIPTION OF THE DRAWINGS

The invention may take physical form in certain parts and arrangement of parts or certain process steps, preferred embodiments of which will be described in detail in this specification and illustrated in the accompanying drawings, which form a part hereof and wherein.

DETAILED DESCRIPTION OF THE INVENTION

Figure 1:
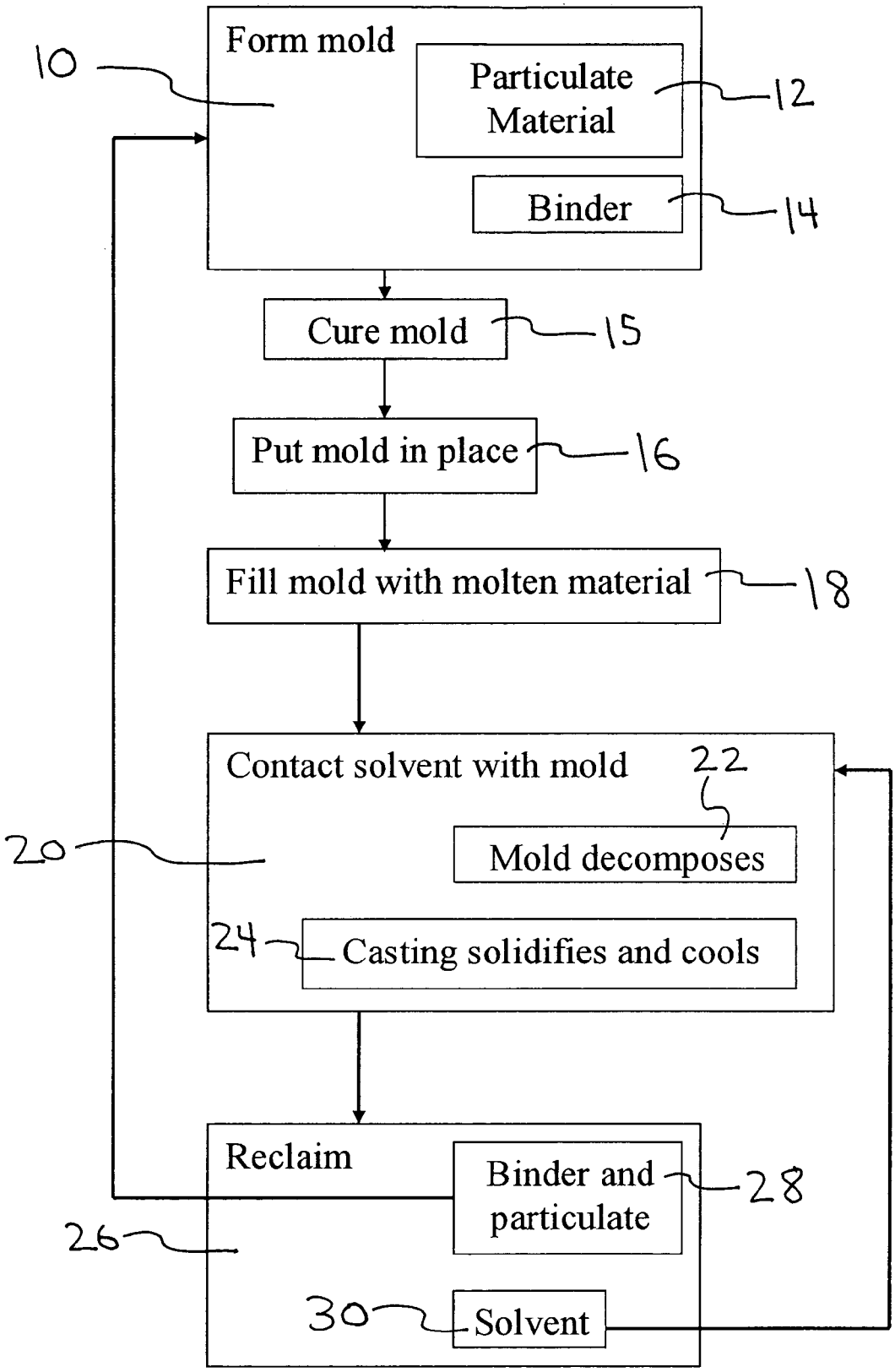
FIG. 1 is a flow chart of the steps associated with one embodiment of the present invention.

Referring now to the drawings, wherein the showings are for purposes of illustrating the preferred embodiments of the invention and not for the purposes of limiting the same, FIG. 1 illustrates the steps of the process of one embodiment of the invention. It is to be noted that the invention is suitable for the casting of any metal, including non-ferrous alloys based on magnesium, aluminum and copper, as well as ferrous alloys and high temperature alloys such as nickel-based and similar alloys. First, a mold is formed, step 10. This step will be discussed in more detail below.

The mold is composed of an aggregate, which includes a particulate or granular material 12 and a binder 14. The particulate material 12 includes a material having a minimal density, minimal thermal capacity and minimal thermal conductivity (i.e. minimal heat diffusivity) to reduce the heat that is extracted from the cast molten metal. By minimizing the heat that is extracted, the molten metal does not solidify prematurely and thus flows smoothly into all portions of large molds including the thin areas thereof. The particulate material 12 will also preferably be non-toxic and environmentally friendly, be compatible with water, have a Mohs hardness of 5 or above to prevent degradation and wear and be electrically neutral. The particulate material 12 also preferably has a low coefficient of thermal expansion and no phase change, allowing use of the mold in high temperature applications while retaining high dimensional accuracy.

The aggregate of the cured (hardened) binder together with the particulate material is preferably absorbent of water or oil and permeable thereto.

Because the metal temperature for nonferrous alloys during metal casting is typically above 700° C. (1300° F.), cooling of the molten metal by radiation is also a significant factor to consider. In order to maintain all of the molten metal thermal energy in the molten metal itself during fill, the amount of heat lost due to radiation should also be minimized. A white aggregate, which has the highest expected reflectance and least heat adsorption, is therefore desirable.

The particulate material 12 may be composed of approximately spherical particles, which impart a good surface finish to the casting and minimize tool wear. The size of the particles should be fine enough to allow the creation of a good surface finish on the casting.

Exemplary materials that may be used for the particulate material 12 include, but are not limited to, crushed pumice particles (an amorphous foamed mineral); silica sand; ceramic, glass or refractory micro-bubbles; and mixtures of the above. Other types of volcanic glass such as perlite may also be used. Generally, any type of granular material having a quantity of trapped air between and/or within the packed particles and having a low heat capacity and thermal conductivity may be used.

One preferred material is a mixture of pumice and silica sand. The pumice may be, for example, siliceous in composition (rhyolite or dacite) or basaltic (reticulate). The addition of silica sand to the pumice serves several purposes. For one, the sand absorbs energy in the drying process and remains hot in the surrounding pumice, thereby facilitating moisture evaporation. Also, the blocky surface characteristics of the sand increase the green and dried mold strength. In addition, the hot silica sand, after the mold is cured and if immediately used to cast, aids the mold removal process by transforming the water to steam, thus uniformly increasing the removal of mold particles so as to more efficiently break the bonds between the pumice and sand components. Finally, the silica sand aids in the removal or "stripping" of the mold from the mold pattern, increasing the green strength and the mass to help the mold pull more uniformly from the pattern. In such a blend, the size of the pumice particles and the sand particles are preferably within an order of magnitude or each other. Alternately, the aggregate may include pumice particles or with other additives, without the addition of sand.

Compared to the weight of a silica sand mold, the greatly reduced mold weight of the pumice/sand aggregate is important as well by reducing the amount of binder required, since less tensile strength is necessary to hold the mold together. Reduced local particle bond strength, due to the reduced binder content, assists in the later removal of the mold by water at lower application pressure. Any increase in water pressure is undesirable to avoid damaging the casting.

A specific granulated material suitable for use alone or in combination with sand in the aggregate of the present invention is KT 500 or KT 2500 High Density glass Micro-bubbles or a combination thereof, available from KT Minerals, Inc., located in Anthony, N.M. KT 500 and KT 2500 are non-hazardous glass micro-bubbles composed of an amorphous glass of sodium, potassium and aluminum silicate. The material may or may not be dielectrically neutral, has a pH of 7, is chemical resistant, is non-flammable, is non-hydroscopic, and is stable at temperatures ranging from −273° C. to over 1350° C. In its micro-bubble form, the material has a specific gravity for KT 500 of about 0.66 g/cc and for KT 2500 of about 0.9 g/cc.

Another exemplary material that may be used as the particulate material is cenospheres, a constituent of fly ash. Cenospheres are inert, naturally occurring hollow microspheres comprised largely of silica and alumina. Although their physical and chemical makeup may vary, a typical cenosphere may contain, e.g., about 55–75 weight percent (wt. %) amorphous silica, 10–25 wt. % alumina, 1–10 wt. % sodium oxide, 1–10 wt. % potassium oxide, 0.1–5 wt. % calcium oxide and 0.1–5 wt. % encapsulated iron oxide. The exact composition of the cenospheres is not critical. Cenospheres are light in weight with a specific gravity ranging from about 0.70 to about 2.35, depending on the grade. They have low thermal capacity and thus extract little heat from molten metal, allowing increased flow of molten metal in the mold.

The particulate material 12 is bonded with a binder 14 that is preferably water soluble to form the aggregate. Water is preferably added to the binder. This water aids in wetting the pumice particles of the aggregate to uniformly disperse the binder as well as providing the required "green strength" to allow the mold to be drawn from a pattern in its manufacture. As used herein, the term "green" is meant to include an undried or uncured state. Without the addition of water, the aggregate may become too dry to adequately bond.

Although the water increases the green strength of the mold, it may decrease the bond strength upon drying. This is thought to be due to the process whereby evaporating water from one section of the mold passes through an already cured section which has previously dried, thereby breaking down the dehydrated linked bonds between the binder and the particulate material. This effect is, in essence, a self removal of the mold. To minimize this effect, the cured mold should be permeable to allow water vapor to pass through it.

An exemplary binder 14 possessing the described characteristics is based on phosphate glass, a binder that is known in the art. Phosphate glass is an amorphous, water soluble material that includes phosphoric oxide, $P_2O_5$, as the principal constituent with other compounds such as alumina and magnesia or sodium oxide and calcium oxide. Other exemplary binders 14 include inorganic silicates, such as sodium silicate, and borates. Another useful binder is magnesium sulfate. Further exemplary binders 14 include systems wherein an organic binder, such as urethane, is added to a known inorganic binder and the organic binder is in the range of from about 1 weight percent (wt. %) to about 51 wt. % of the binder system. A suitable binder is available under the trade name CORDIS from HA International of Chicago, Ill. More information concerning the binder can be found in applicants' recently filed application entitled "Mold-Removal Casting Method and Apparatus." This application was filed on Jul. 7, 2003. It is incorporated herein by reference in its entirety.

Once the mold is formed, at step 10, it is then cured either prior to or after removing it from the pattern at step 15 and subsequently positioned so that it may be filled with a molten metal, at step 16. For example, the mold may be held above the floor of a foundry as known in the art. The molten metal fills the mold, using any appropriate method, at step 18. For example, the mold may be designed to allow the molten metal to flow according to gravity, known in the art as gravity pouring or it may be counter-gravity filled using a pump.

After pouring the metal into the mold, at step 18, the mold is subjected to the action of a solvent, such as by spraying, at step 20. As mentioned, the binder 14 is soluble. Thus, the solvent dissolves the binder and thereby causes the mold to decompose 22. As the mold decomposes 22, the casting is exposed to the solvent, which causes the casting to solidify and cool rapidly 24.

It should be recognized that a thin shell of solidified metal is formed at the interface of the molten metal and the mold almost instantly. Thus, when the solvent contacts the casting, it contacts the already solidified shell and not the molten metal directly. The solidified metal of the casting continues to be cooled by the continuous application of the liquid, and so acts as a chill to remove heat from the molten metal, thus solidifying the molten metal more quickly. At the same time, the already solidified metal of the casting is prevented from heating up significantly due to continual spraying or other contact with the solvent. As long as additional, relatively cool, solvent is delivered, the solvent is also prevented from heating up significantly.

The casting is thus separated from the mold and simultaneously solidified and cooled in a rapid manner, resulting in a casting that has been made with an inexpensive mold and has solidified rapidly, thereby having advantageous mechanical properties. Moreover, the delivery of a solvent in a manner such as spraying may have a strong zonal cooling effect on the cast metal, encouraging the whole casting to solidify progressively, thereby facilitating feeding and securing the soundness of the casting.

An exemplary solvent is water. Water is environmentally acceptable and has high heat capacity and latent heat of evaporation, allowing it to absorb a significant amount of heat before evaporating. It can thus provide an optimum cooling effect to enable rapid solidification of the cast metal.

Other solvents may include liquids or gases that decompose the binder 22 and cool the cast metal 24. For example, known quenching agents may be used with appropriately soluble binders. Moreover, a grit may be entrained in the cooling fluid (liquid or gas) and used to decompose the mold 22 by abrasion, at the same time as the mold is being washed away by the fluid. The grit may also serve a second purpose, namely to allow the cast metal to be peened by the grit as it is cooled 24, yielding additional advantageous surface properties.

As the mold decomposes 22 when it is sprayed with the solvent 20, at least some of the mold constituents may be reclaimed, step 26. The particulate material and/or can be gathered 28 for drying and re-use. Moreover, the solvent can be collected 30, filtered and recirculated for further use. In some systems, it may also be possible to reclaim the binder as well through a reclamation system as known in the art.

Figure 2:
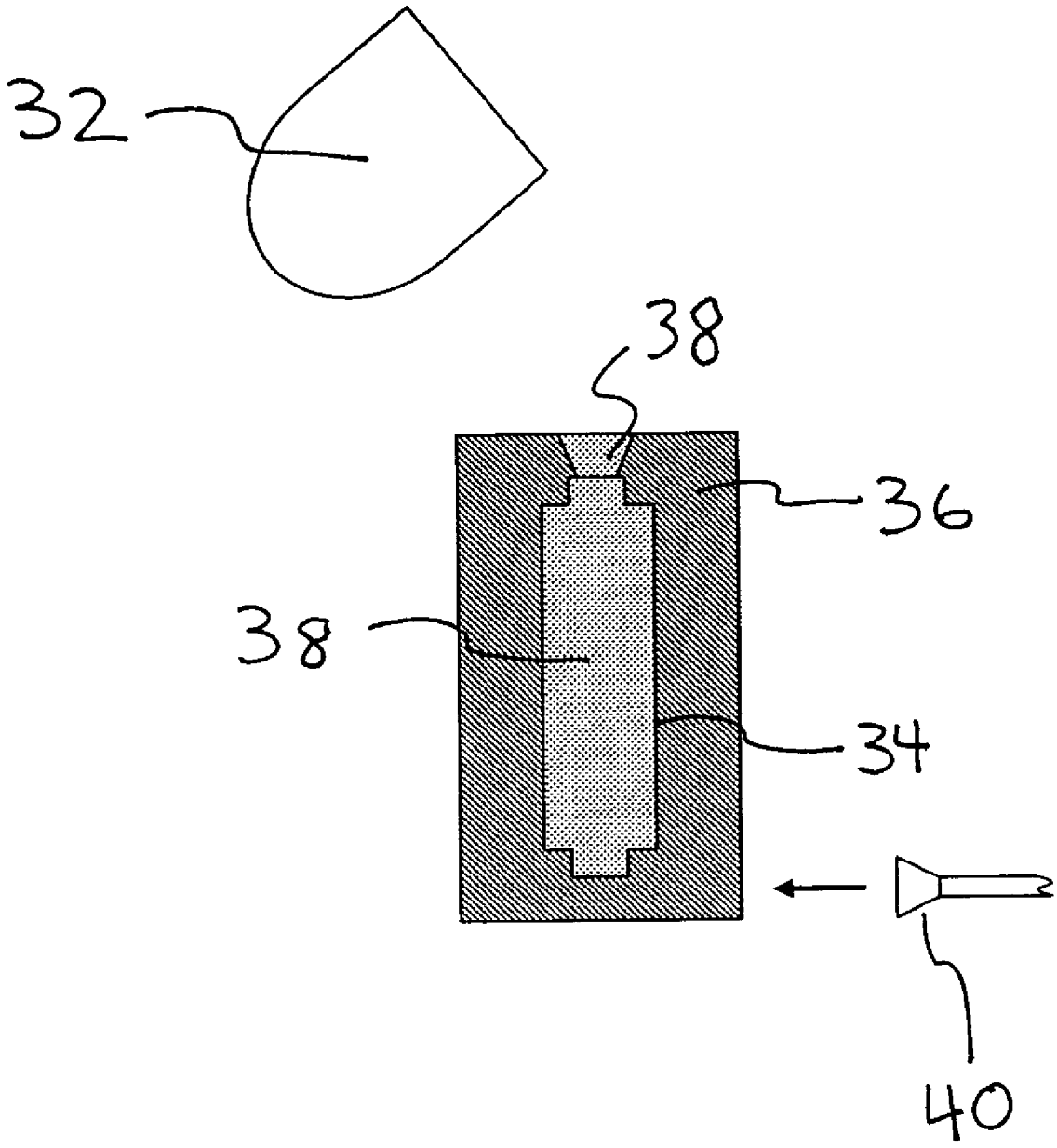
FIG. 2 is a schematic side view of a layout of another embodiment of the present invention.

Turning now to FIG. 2, a schematic illustrating the apparatuses involved with the step 20 (referring back to FIG. 1) of subjecting the mold to a solvent is provided. A crucible or ladle 32 has been used to pour molten metal 33 into a mold cavity 34 that is defined by a mold 36 of the above-described aggregate and binder composition. A riser 38 is the last portion to be cast. One or more spray nozzles 40 direct one or more sprays of solvent A, such as water, at the mold 36. The sprays, A, which can be termed jets, may be delivered in any suitable configuration from a narrow stream to a wide fan and may be a steady stream or a pulsating stream, as dictated by the particular application.

The delivery of solvent, i.e., the spray, may begin at the base of the mold 36. The mold 36 may be lowered to allow the nozzle 40 to deliver the solvent in a progressive manner to intact portions of the mold 36 so that the mold 36 entirely decomposes. In the alternative, the mold 36 may remain stationary and the one or more nozzles 40 may be caused to move in order to progressively deliver a solvent jet A to decompose the entire mold 36. In order to allow the entire circumference of the mold 36 to be contacted by the one or more jets A for rapid decomposition, the mold 36 may be rotated or the one or more spray nozzles 40 may be moved about the mold 36.

The rate and pressure of delivery of the jet A are of a setting that is high enough to decompose the mold 36, yet low enough to allow the solvent to percolate through the mold 36 so that percolated solvent arrives at the cast metal 33 ahead of the full force of the jet A. In this respect, the mold should be permeable to the solvent during mold removal. For example, high volume, low pressure delivery in a range of about 0.5 to 50 liters per second, l/s (10 to 100 gallons per minute, gall/m) at a pressure ranging from 0.03 to 70 bar (0.5 to about 1,000 pounds per square inch, psi) may be advantageous.

In this manner, the percolated solvent causes the formation of a relatively solid skin on the cast metal 33 before the metal 33 is contacted by the force of the jet A, thereby preventing distortion of the metal 33 or explosion from excessive direct contact of the solvent with the molten metal 33. The addition of a surfactant, as known in the art, to the solvent in the jet A or to the binder formulation may enhance percolation of the solvent through the mold 36. In addition, at least some of the heat that is absorbed from the molten metal 33 by the mold 36 may increase the temperature of the solvent as the solvent percolates through the mold 36, thereby increasing the energy of the solvent and causing it to remove the mold 36 more rapidly.

An additional consideration for the rate and pressure of the delivery of the jet A is the contact with the cast metal 33 once the mold 36 has decomposed. The rate and pressure of the jet A must be low enough to prevent damage to the casting 33, but must be high enough to overcome the formation of a vapor blanket. A vapor blanket is formed by the evaporation of the solvent that has percolated through the mold 36 to contact the metal 33 in forming the skin on the casting 33. The vapor blanket reduces the transfer of heat away from the cast metal 33 and is detrimental to the rapid cooling that is necessary to obtain the desirable properties and effects that are described above. Thus, it is advantageous to adjust the jet A to overcome the vapor blanket.

Control of the jet A may be exercised in at least two ways. The rate and pressure of delivery may be set to achieve all of the above parameters, or two separate settings may be used. If two separate settings are used, one setting may be established for decomposition of the mold 36 and a separate, reduced setting may be timed to replace the decomposition setting when the jet A is about to contact the cast metal 33. Of course, the manner in which the jet A is delivered, i.e., narrow stream, wide fan, steady flow, intermittent pulse, etc., affects the rate and pressure settings of the jet A accordingly.

The solidification of the casting 33 beginning at its base and progressing to its top allows the riser 38 to remain in a molten state for the maximum length of the time so that it may continue to feed the casting 33. By feeding the casting 33 for a longer period of time, voids created by shrinkage of the metal 33 upon cooling are minimized. Solidification from the base of the casting 33 to the top also allows length or longitudinal changes to take place before solidification is complete, thereby eliminating any significant strain during solidification and any significant buildup of internal stress that often occurs in quenching.

It is important to note that a single nozzle 40 is not limited to a base-to-top direction of spray as described above. Depending on the application, it may be desirable to spray the jet A from the top of the mold 36 to the bottom, from a midpoint to one end, or in some similar pattern. In addition, the application of solvent is not limited to a single direction or nozzle. For example, two or more may be present, removing the mold 36 from multiple directions. Each can spray a respective fluid at the mold 36. In this manner, the mold 36 may be decomposed more rapidly and uniformly, if desired in a particular application. Any number of nozzles may be present, as a great number of nozzles may be advantageous for large or complex molds 36 or a few nozzles may provide optimum coverage for other molds 36. As with a single nozzle, the mold 36 may be rotated and moved vertically to allow complete distribution of the jets or the nozzles may be moved while the mold 36 and casting 33 remain stationary.

In addition, when multiple nozzles are used, it may be advantageous to time the function of the nozzles to complement one another. For example, a nozzle at the base of the mold may be engaged, thereby spraying the jet vertically upwards at the bottom of the mold 36. The bottom nozzle may be turned off and lower side nozzles may be engaged to spray at the mold 36, and so on. Such coordinated timing of multiple nozzles may optimize the decomposition of the mold 36 and/or the direction of cooling of the cast metal 33 to provide the desired characteristics of the casting 33. The water, or other fluid, can be sprayed at varying pressures and rates. A range that has proven satisfactory ranges from a minimum of about 4 liters (1 gallon) at about 3 bar (40 psi) to about 11 liters (3 gallons) at about 100 bar (1,500 psi).

It should also be appreciated that the casting can be further cooled after the mold is removed by continuing to spray the casting with a cooling fluid. The humidity of the environment does not appear to matter significantly in the removal of the mold. However, maintaining a high humidity or prewetting the mold may speed the mold removal process.

Figure 3:
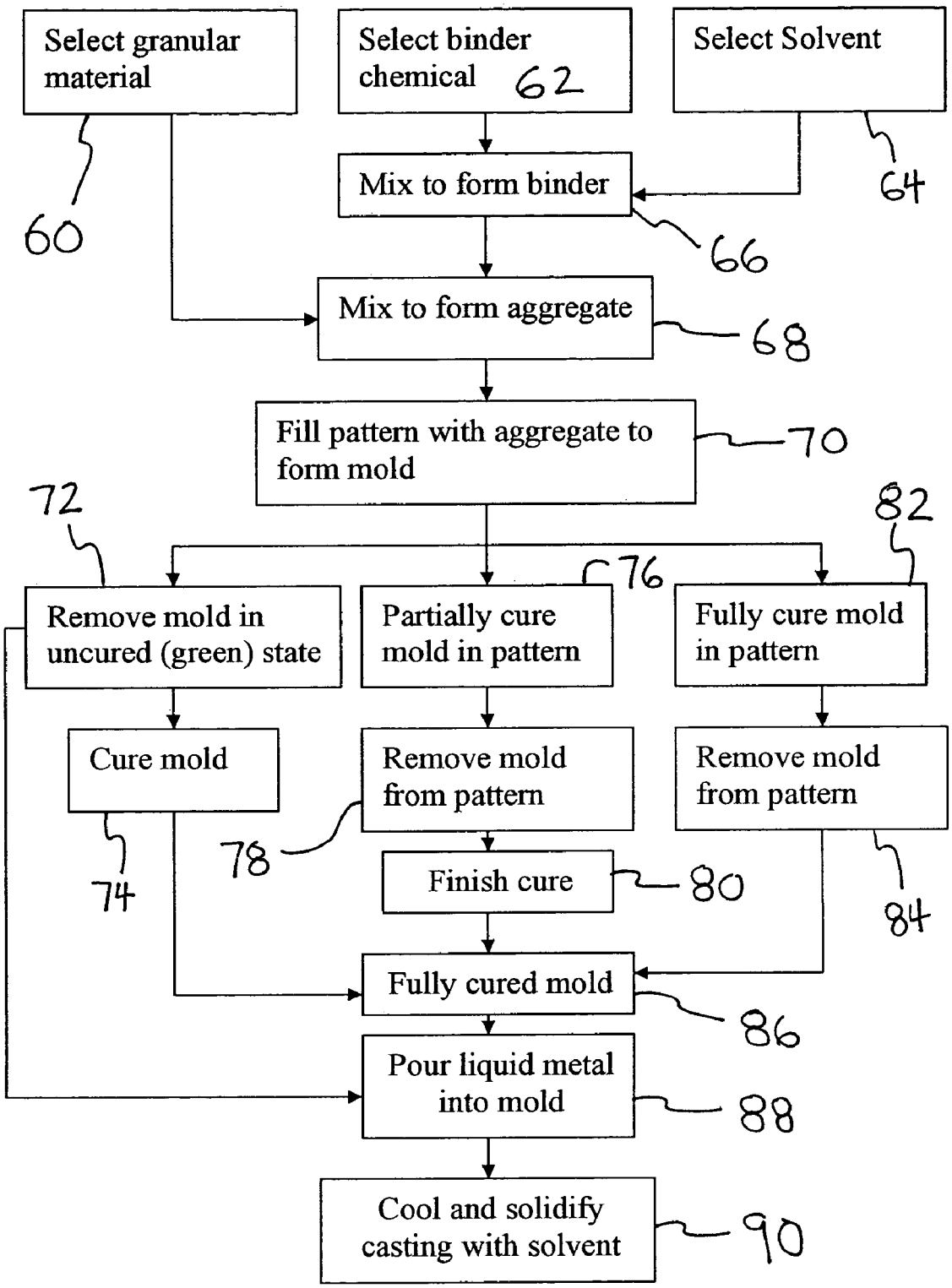
FIG. 3 is a flow chart of the steps associated with still another embodiment of the present invention.

To manufacture the mold, certain steps outlined in FIG. 3 may be followed. First, a granular material 60, binder chemical 62, and solvent (if present) 64 are all selected. As stated one preferred particulate material can be a mixture-of pumice and silica sand. A preferred ratio of pumice to sand is from 2:1 to 6:1 by volume, even more preferably about 3:1 by volume. The binder chemical and solvent (if present) are mixed to form a binder 66. The granular material and binder are then mixed 68 to form an aggregate. The binder and particulate material can be mixed either by hand or with a mechanical mixer to form a uniformly moist aggregate mixture.

The aggregate is then packed into a pattern or core box as at 70 to form one part of a two-part mold having upper and lower mold halves. This step may include compacting the aggregate compress it in the pattern. This may be done by tucking and compressing the mixture by hand in a manner well-known to those skilled in the art. Excess compacted material may be removed from the open side of the pattern using a steel straight edge as a scraper (not shown).

In one embodiment, the aggregate mold may then be removed from the pattern in its uncured (green state), as shown at 72. Depending on the shape of the pattern, this may be accomplished by flipping the pattern with the open side of the pattern placed on a flat surface and the mold removed, leaving the compacted aggregate mold-half in its green state on the plate. The green state aggregate mold-halves may then cured or dried as at 74, which may be done, for example, by placing the mold halves in either a conventional or microwave oven. Alternately, the mold may be used for casting without curing by pouring liquid metal into the mold 88 upon removal from the pattern. Additionally, the curing process is greatly facilitated by placing the mold halves on a perforated plate and drawing air through the permeable mold. Preferably the air is heated to a temperature of 50° C. or more.

In a second embodiment, the aggregate mold is at least partially cured in the pattern, as at 76. Once the mold is removed from the pattern at 78, it is subsequently fully cured 80.

In a third embodiment, the mold is fully cured while still in the pattern 82. The mold is then removed from the pattern at 84. In the last two described emobodiments, by curing or partially curing the mold or core in the pattern, the potential for the distortion of the very weak mold or core in their green state is avoided. A fully cured mold is produced 86. Metal tooling therefore is capable of higher temperatures and therefore of faster production cycles. In any of these embodiments, once the liquid metal is poured into the mold at 88, the resulting casting is cooled and solidified at 90, as described above.

To illustrate the design and the effect of the process and apparatuses of the present invention, reference is made to the following examples. It is to be understood that the present invention is not limited to the examples, and various changes and modifications may be made in the invention without departing from the spirit and scope thereof.

EXAMPLES

Example 1

Exemplary Embodiment of the Present Invention

A test specimen was formed by mixing 710 $cm^3$ (about 3 cups) of KT 500 pumice with 237 $cm^3$ (1 cup) Wedron 505 silica sand. The pumice and sand were mixed to form a uniform particulate mixture. A binder mixture was produced using 15 grams HA Cordis 4615 with 5 grams of HA Cordis 4820BF in a 50% ratio with water. The binder mixture was mixed with the particulate mixture using an electric blender for three (3) minutes to form a uniformly moist green state aggregate. The green state aggregate was then hand packed and compacted about 20% into each of the two halves of a two-part pattern with a view to form two half molds. Each aggregate mold half was removed from the patternwork in its green state and dried. Drying was conducted using both a microwave oven (rated at 1.38 KW) using a three-minute cycle at the highest power as well as using a hot air oven with convection heating at a setting of 180 C. (350° F.) for 15–45 minutes.

The present invention is suitable for various alloys, including, for example, the 7XXX series aluminum alloys that normally have very long freezing rates and are not therefore normally castable in an aggregate type mold. The very fast solidification rates according to the present invention would enable the casting of these long freezing rate alloys. Due to the fast quenching rates, on the order of 30 to 50° C. per second (60 to 100° F. per second), the present invention may reduce or eliminate solution or aging treatment times, thereby providing a cost savings. The process may also be useful in 2XXX wrought series aluminum alloys that are known to be limited in their use for cast products because of the tendency of the alloys to hot tear, as well as inexpensive aluminum casting alloys such as 319 and 333 series.

By subjecting a mold that has a soluble binder to a solvent, the mold is dissolved, simultaneously causing the casting to solidify and cool. In this manner, a substantially cooled casting that has been separated from its mold is achieved rapidly. In using an aggregate made from a material that has a low heat diffusivity such as a mixture of pumice and sand, the present invention allows the mold to only define the shape of the cast product and not to extract heat from the casting. The extraction of heat is carried out by the controlled process of freezing the casting with a solvent in a directional manner to promote the maximum properties, maximum soundness, eliminate solidification strain and consequent need for stress relief of the casting. By carrying out the heat extraction in a separate step, the filling of the mold, whether by gravity pouring, tilt pouring, or by counter gravity filling, encourages flow of the molten metal while minimizing premature solidification, allowing castings of complex geometry or thin sections to be achieved. By maintaining the superheat in the molten metal, the transformation of the metal to a semisolid state during the filling process is retarded, thus allowing the molten metal to advance like a complete liquid rather than as a slurry or in a viscous flow that are typically experienced in the casting techniques currently used in the industry.

The benefits of such a uniform liquid fill include quiescent metal flow and mold filling, the ability to cast large heavy sections from a single metal inlet or ingate, the reduction of the advancing metal's resistance to flow in the mold because of premature partial solidification, thereby reducing the pressure necessary to instigate flow and reducing metal penetration into the mold, which results in undesirable surface finish, and the ability to fill large molds with thin sections.

In addition, the present low-chill molds will exhibit high dimensional stability. Such molds need not display any volume changing transformations and have low coefficients of thermal expansion. This is in contrast to molds that absorb high amounts of thermal energy during fill and solidification, which may distort due to the extensive regions of the mold changing temperature. For example, as discussed above, an alpha-beta quartz transformation can occur in silica sand aggregates, resulting in an expansion of over 1% at a temperature of approximately 570° C.

The application of a solvent need not be via a nozzle. One could, for example, direct the solvent to the mold via an impeller, over a waterfall, or other means. Furthermore, it is conceivable that a binder and solvent combination could be developed of such effectiveness that the mold could be removed without rapid movement of the solvent, such as by dipping the mold into a bath of the solvent. In such a system, the water or other solvent (whether flowing or stagnant) would progressively dissolve the soluble binder, slowly disintegrating the aggregate. The casting, in turn, would progressively solidify in a highly desirable rapid and directional mode as in other embodiments of the invention, to provide excellent properties and soundness in the resulting final casting. Thus, while one means of applying the solvent is via a nozzle, other means are also conceivable.

Metal castings typically include feeders (risers) that allow molten metal to be fed to the castings as they cool and shrink, thereby reducing any voids caused by the shrinkage. Once a casting has cooled, the feeder must be cut off. With the present invention, the volume of the feeder is extremely small because of the efficiency of the directional solidification. In addition, it can be envisioned that at least one jet of solvent may be designed to deliver solvent at a rate, volume and area sufficient to cut off the feeder whilst the feeder neck is still in a semi-molten state, thereby eliminating an additional process step of the prior art.

While in the previous portion of the specification it was assumed that the entirety of the mold is made from a particulate material and binder, it should be appreciated that molds could be partially composed of an aggregate according to the present invention and partially from conventional mold materials. For example, a mold could be constructed with one wall being made of metal and three walls of aggregate according to the present invention. Alternatively, the mold could have three sides of conventional mold materials (such as silica sand; with either a conventional clay and water binder or a resin based chemical binder; or a metal) and one side made of an aggregate according to the present invention. Various other alternatives are also possible.

Further, the process, molds and equipment involved are low cost and environmentally friendly. Castings may be produced with a good surface finish and desirable mechanical properties in a rapid and economical manner, while the constituents of the mold may be reclaimed for further use.

The invention has been described with reference to preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A process for the casting of metals, comprising the steps of:

forming a mold from an aggregate comprising a particulate material and a binder;

delivering a molten metal into said mold;

contacting said mold with a solvent;

cooling said molten metal such that it is partially solidified; and removing at least a part of said mold, including at least a part of the aggregate, prior to complete solidification of the molten metal into a casting.

2. A process according to claim 1, wherein said binder is water soluble.

3. A process according to claim 2, wherein the step of forming a mold includes adding water to said aggregate and binder.

4. A process according to claim 1, wherein said particulate material comprises pumice, silica sand, or a blend thereof.

5. A process according to claim 1, wherein said particulate material comprises glass, ceramic or refractory hollow spheres.

6. A process according to claim 1, wherein said binder comprises one or more components selected from the group consisting of phosphate glass, inorganic silicates, phosphates, borates, sulfates including magnesium sulfate, organic binders, and mixtures thereof.

7. A process according to claim 1, wherein said mold is cured prior to delivering said molten metal into said mold.

8. A process according to claim 1, wherein said solvent comprises water.

9. A process according to claim 1, further comprising the steps of recovering a removed part of said mold and recovering at least a portion of said solvent.

10. A process according to claim 1, wherein said step of contacting comprises spraying said mold with said solvent.

11. A process according to claim 1, wherein said step of contacting comprises permeating said mold with said solvent.

12. A process according to claim 1, wherein said solvent is delivered to said mold at a pressure from 0.03 to 70 bar and in an amount of from 0.5 to 50 liters per second per kg of casting weight per cm of casting section thickness.

13. A process according to claim 1, wherein said solvent contains at least one of a grit and a surfactant.

14. A process according to claim 1, wherein the steps of (i) removing at least a part of said mold and (ii) cooling the molten metal are performed simultaneously.

15. A process according to claim 1, wherein the application of said solvent is continued until the entire mold is removed.

16. A process according to claim 1, wherein the application of said solvent is continued until the entire casting is both cleaned from residual adhering aggregate and sufficiently cool to be conveniently handleable.

17. A process according to claim 1, wherein said steps of (i) contacting a solvent with said mold; (ii) cooling said molten metal such that it at least partially solidifies to form a casting; and (iii) removing at least a part of said mold are performed by lowering said mold into a bath of said solvent.

18. A method for forming a casting from a molten metal, comprising the steps of:

forming at least a part of a mold from an aggregate comprised of a particulate material and a soluble binder;

delivering a molten metal into said mold;

contacting said at least a part of said mold with a solvent;

removing said at least a part of said mold, including at least a part of the aggregate; and solidifying and cooling at least a part of the molten metal to form a casting.

19. A method according to claim 18, wherein said step of cooling comprises initially freezing a shell of solidifying metal around said molten metal with said solvent.

20. A method according to claim 18, wherein said step of cooling comprises using an already solidified and cooled portion of the casting as a chill to removed heat from a still molten portion of the casting.

21. A method according to claim 18, wherein said solvent comprises water.

22. A method according to claim 18, wherein said particulate material comprises one of silica sand; pumice; cenospheres; ceramic, refractory, or glass microbubbles; and mixtures thereof.

23. A method according to claim 18, wherein said binder comprises a component selected from the group consisting of phosphate glass, inorganic silicates, phosphates, borates, sulfates including magnesium sulfate, organic binders, and mixtures thereof.

24. A method according to claim 18, wherein said steps of (i) contacting said at least a part of said mold with a solvent; (ii) removing said at least a part of said mold; and (iii) solidifying and cooling the molten metal to form a casting are performed by lowering said mold into a bath of said solvent.

25. A process for the casting of metals, comprising:

forming a mold;

delivering a molten metal including aluminum into the mold;

contacting the mold with a solvent including water;

cooling a shell of solidified metal, formed at an interface of the molten metal and the mold, with the solvent; and, removing at least a portion of the mold with the solvent while molten metal remains within the shell.

26. The method of claim 25 wherein the mold comprises a particulate material including a mixture of a) hollow microspheres, cenospheres or pumice, b) silica sand, and c) a binder.

27. The method of claim 25 wherein the solvent comprises water.

28. The method of claim 25 wherein said step of delivering comprises spraying the solvent.

29. The method of claim 28 wherein the solvent is sprayed via at least one nozzle.

30. The method of claim 29 wherein two nozzles are employed and two streams of solvent are sprayed.

31. The method of claim 25 further including subsequently cooling the shell of solidified metal with the solvent until all of the molten metal is solidified.

32. The method of claim 31 further including simultaneously continuing the step of removing at least a portion of the mold with the solvent until substantially the entire mold is removed.

33. A method according to claim 25, wherein said step of cooling comprises using the shell of solidified metal as a chill to remove heat from the molten metal within the shell.

34. A process for the casting of metals comprising the steps of:

forming a mold from an aggregate comprising a particulate material and a binder;

delivering a molten metal into the mold;

contacting the mold with a solvent;

dissolving at least a part of the binder; and removing at least a part of the particulate material of the mold, prior to complete solidification of the molten metal into a casting.

35. The process of claim 34 wherein the particulate material comprises at least one of pumice, cenospheres, glass, ceramic or refractory microbubbles and silica sand.

36. The process of claim 34 wherein the step of contacting comprises spraying the mold with the solvent.

37. The process of claim 34 wherein the step of contacting comprises permeating the mold with the solvent.

38. The process of claim 34 wherein the steps of dissolving at least a part of the binder and removing at least part of the particulate material are performed simultaneously.

39. The process of claim 34 wherein the steps of dissolving and removing are continued until the entire mold is removed.

40. The process of claim 34 wherein the steps of dissolving and removing are continued until the casting is sufficiently cool to be conveniently handleable.

41. The process of claim 34 wherein the steps of dissolving and removing are performed by lowering the mold into a bath.

42. The process of claim 34 further comprising initially freezing a shell of solidifying metal around the molten metal with the solvent.

* * * * *